United States Patent [19]

Altmann et al.

[11] 4,349,801

[45] Sep. 14, 1982

[54] SINGLE-PHASE TRANSFORMER WITH WINDINGS CAST IN CASTING RESIN

[75] Inventors: Garhard Altmann, Kirchheim; Richard Pfeiffer, Stein-Deutenbach, both of Fed. Rep. of Germany

[73] Assignee: Transformatoren Union AG, Stuttgart, Fed. Rep. of Germany

[21] Appl. No.: 188,454

[22] Filed: Sep. 18, 1980

[30] Foreign Application Priority Data

Sep. 25, 1979 [DE] Fed. Rep. of Germany ..... 2938792

[51] Int. Cl.[3] ..... H01F 15/04; H01F 27/02

[52] U.S. Cl. ..... 336/84 C; 336/96; 336/107

[58] Field of Search ..... 336/96, 84 R, 84 C, 336/107, 205, 213, 105, 192

[56] References Cited

U.S. PATENT DOCUMENTS 3,617,966 11/1971 Trench ..... 336/96 X 4,019,167 4/1977 Baker ..... 336/96

*Primary Examiner*—Thomas J. Kozma

*Attorney, Agent, or Firm*—Herbert L. Lerner; Laurence A. Greenberg

[57] ABSTRACT

Single-phase transformer, including windings being wound around an axis and cast in resin forming a cast resin body, the cast resin winding body having an outer surface and a rectangular window formed therein with sides disposed in given planes, a wound core formed of tape material extended through the window, two flanges being cast with and integral with the cast resin winding body on opposite sides thereof and parallel to the winding axis and to the window, the flanges having outer edges, mutually parallel inner surfaces substantially disposed in the plane of the narrow sides of the window and grooves formed in the inner surfaces in the vicinity of and parallel to the outer edges, an encapsulation for the wound core being anchored in the grooves, and a grounded metallization layer formed on the outer surface of the cast resin winding body at least immediately adjacent to the wound core.

6 Claims, 4 Drawing Figures

SINGLE-PHASE TRANSFORMER WITH WINDINGS CAST IN CASTING RESIN

The invention relates to a single-phase transformer with a core wound of tape material and windings cast in casting resin, for instance, for installation on poles or directly in the soil in line with buried cables.

Such transformers which are equipped with windings cast in casting resin have more recently been used as distribution transformers to an increasing degree, particularly because of their very high operating safety. In U.S. patent application Ser. No. 46,859 filed June 8, 1979, now U.S. Pat. No. 4,236,134 a polyphase transformer is proposed, in which the windings and the three-leg stacked core are hermetically enclosed by casting with synthetic resin and which can be dug in by suitably fitting it with connectors, and can be connected to buried cables.

While this construction with a multiple-leg core is very advantageous for a polyphase transformer which can be cast in synthetic resin, it requires considerable amounts of material of the necessary casting resin if applied to single-phase transformers because of the usually unwound magentic return leg, if the core is to be hermetically sealed.

It is accordingly an object of the invention to provide a single-phase transformer with windings cast in casting resin, which overcomes the hereinaforementioned disadvantages of the heretoforeknown devices of this general type, and to provide for single-phase transformers having an active part which is hermetically encapsulated, an arrangement of the windings and the cores which can be manufactured with normal expenditures, without decreasing its operational safety, and in which the materials used are fully utilized corresponding to their properties.

With the foregoing and other objects in view there is provided, in accordance with the invention, a single-phase transformer, comprising windings being wound around an axis and cast in resin forming a cast resin body, the cast resin winding body having an outer surface and a rectangular window formed therein with sides disposed in given planes, a wound core formed of tape material extended through the window, two flanges being cast or embedded with and integral with the cast resin winding body on opposite sides thereof and parallel to the winding axis and to the window, the flanges having outer edges, mutually parallel inner surfaces substantially disposed in the plane of the narrow sides of the window and grooves formed in the inner surfaces in the vicinity of and parallel to the outer edges, an encapsulation for the wound core being anchored in the grooves, and a grounded metallization layer formed on the outer surface of the cast resin winding body at least immediately adjacent to the wound core.

In accordance with another feature of the invention, the flanges are spaced apart far enough to form a space therebetween after insertion of the wound core, and there is provided cast resin filling the space and hermetically closing in the wound core.

In accordance with a further feature of the invention, the flanges are spaced apart far enough to form a space therebetween, the wound core having a rounded contour, and the outer edges of the flanges being rounded off parallel to the contour of the wound cores, and there is provided preferably shrinkable tape wound around the wound core filling the space, the rounded outer edges of the flanges being covered by at least one layer of the tape protecting the wound core from corrosion.

In accordance with practical constructions and an added feature of the invention, the flanges have outer surfaces, and there are provided connecting sockets for electric shock-proof or contact-safe water-tight high-voltage cable connectors cast or molded onto the outer surfaces of the flanges and water-tight shrink-sleeve terminals for low-voltage connections, i.e. by the shrink-sleeve technique.

In accordance with an additional feature of the invention, the flanges have outer surfaces, and there are provided pin insulator-type feed-throughs cast or molded onto the outer surfaces of the flanges for high and low-voltage side current network connectors for use in pole transformer connections.

In accordance with a concomitant feature of the invention, the metallization layer formed on the outer surface of the cast resin winding body is spaced from the wound core far enough to form a gap therebetween, and there is provided dried quartz sand filling the gap.

The construction according to the invention is very advantageous for single-phase transformers which have to be hermetically encapsulated, because it allows the use of wound cores made of tape material which have very small losses, and requires comparatively small amounts of synthetic resin for the encapsulation or casting of the core, and is therefore to be recommended for economic reasons.

Other features which are considered as characteristic for the invention are set forth in the appended claims.

Although the invention is illustrated and described herein as embodied in a single-phase transformer with windings cast in casting resin, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
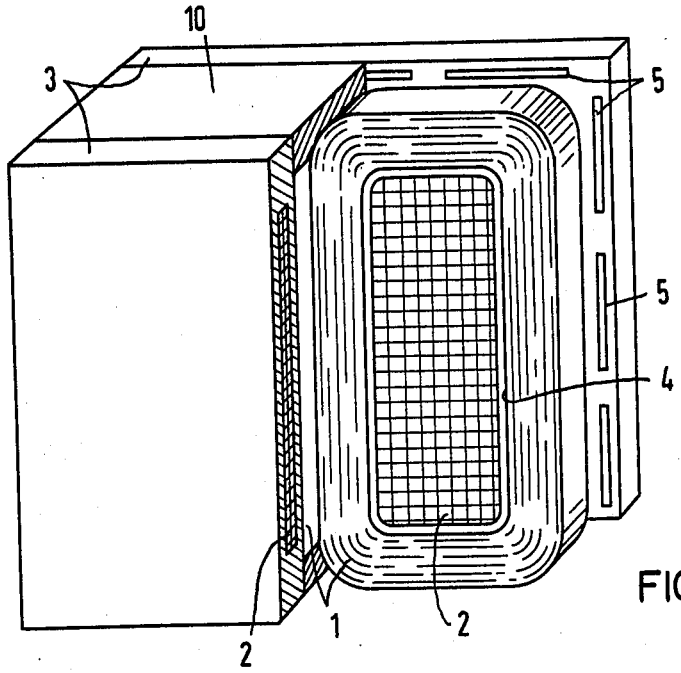
FIG. 1 is a diagrammatic perspective view, partly cut open, of a transformer with a completely embedded tape-wound core.

Referring now to the figures of the drawing and first particularly to FIG. 1 thereof, it is seen that windings 2 which are disposed around a vertical axis, are embedded in synthetic resin, and are therefore completely encapsulated toward the outside. This synthetic resin cast of the windings 2 is extended on two opposite sides to form flanges 3 which are parallel to the axis and also mutually parallel to each other. The windings 2 include at least one low voltage winding, preferably disposed inside, and a high voltage winding disposed radially further to the outside. Inside the windings 2, a centralized window which is parallel to the winding axis is provided in the synthetic resin cast.

Two wound cores 1 made ot tape material are embedded in this window and are disposed symmetrically to each other. Each of these wound cores encloses the windings 2 by itself and therefore lies between the flanges 3. To improve the dielectric strength, at least the surfaces immediately between the windings 2 and the winding cores 1 are provided with a metallizing surface 4, and an electrically conducting connection with a ground wire.

The windings 2, together with their synthetic resin cast, and the winding cores enclosed therein form an approximately parallelipedal block with a depression which extends around the edges of the flanges. To close the wound cores 1 with respect to the outside, and to thereby protect them from corrosion and mechanical damage, this depression is also filled with casting resin 10 in an additional casting operation. To anchor this cast resin layer, grooves 5 are provided at the inside of flange 3 near its edges. The transformer which now has completely straight walls is provided with corrosion protection and electrically effective screening layers depending on the intended use of the transformer.

Figure 2:
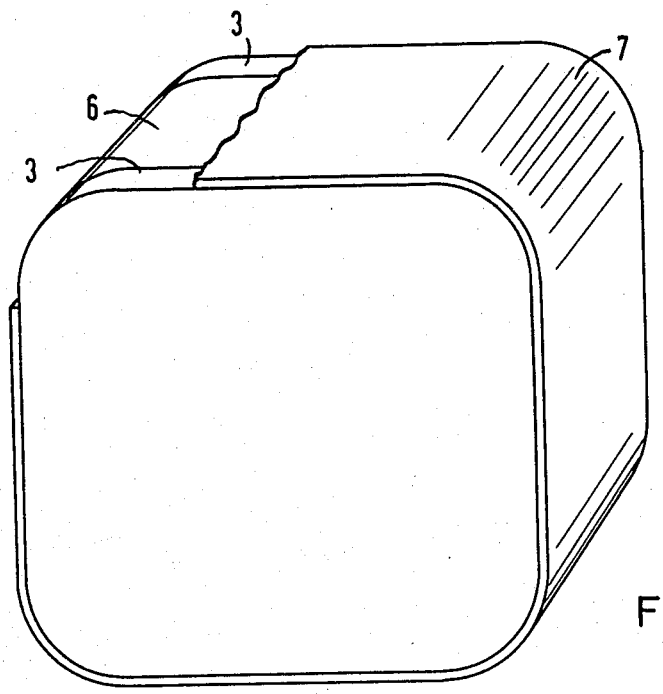
FIG. 2 is another diagrammatic perspective view, partly broken away, of a transformer with tapes of shrinkable material used to enclose the active part.

Instead of casting resin formed around the wound cores 1, the peripheral depression between the flanges 3 can also be filled by winding a tape 6 made of shrinkable material around the cores 1, so that a hermetic encapsulation of the wound cores 1 is also effected if the inside of the flange 3 is properly formed, as shown in FIG. 2. In this form of construction, the corners of the flange 3 are especially rounded so that a smooth outer surface of the transformer again having the shape of a paralleliped results after winding the shrinkable tape into the depression. In many cases, it is practical to enclose this arrangement with a dressing or bandage which mainly serves to improve the corrosion protection. The dressing 7 can be the last layer or layers of the tape 6.

For reasons of clarity, the auxiliary means required to connect the transformers to the current network are not shown in FIGS. 1 and 2.

Figure 3:
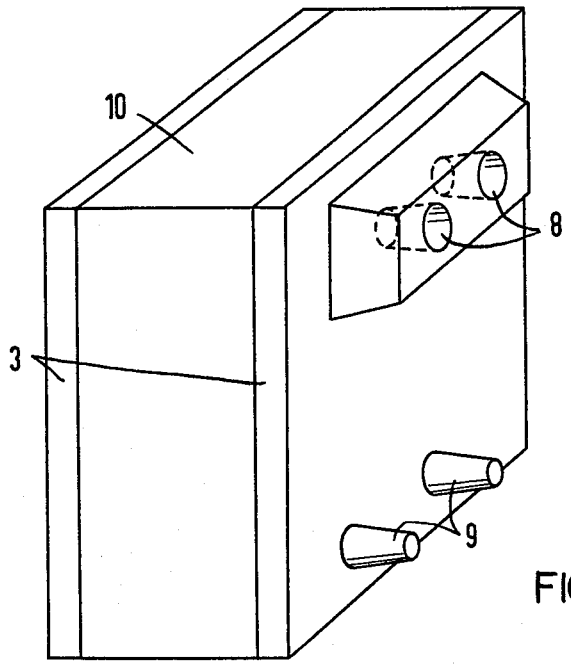
FIG. 3 is a diagrammatic perspective view of an embodiment of the invention, constructed to be buried in the ground.

FIG. 3 shows a correspondingly equipped cast resin transformer in a shock-proof construction which can be buried in the soil. For the connection of the high voltage of this transformer, connector sockets 8 are provided in a water-proof arrangement. The connection on the low voltage side is effected by terminals 9, so that the shrink-sleeve technique is especially suited for insulation.

Figure 4:
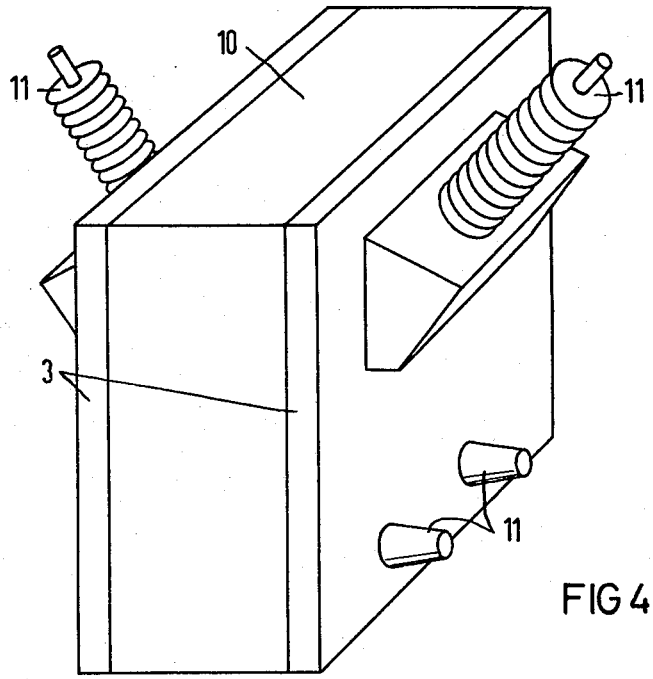
FIG. 4 is a further diagrammatic perspective view of an embodiment of the single phase transformer according to the invention, constructed for mounting on overhead line poles.

FIG. 4 shows a variation of the transformer, according to the invention which is made for installation on overhead line poles, wherein the electrical connection is effeced by feed-throughs 11, similar to pin insulators.

The gap left between the metallization layer 4 on the cast resin winding body 2 and the wound core 1 may be filled with dried quartz sand.

There are claimed:

1. Single-phase transformer, comprising windings being wound around an axis and cast in resin forming a cast resin body, said cast resin winding body having an outer surface and a rectangular window formed therein with sides disposed in given planes, a wound core formed of tape material extended through said window, two flanges being cast with and integral with said cast resin winding body on opposite sides thereof and parallel to said winding axis and to said window, said flanges having outer edges, mutually parallel inner surfaces substantially disposed in the plane of the narrow sides of said window and grooves formed in said inner surfaces in the vicinity of and parallel to said outer edges, an encapsulation for said wound core being anchored in said grooves, and a grounded metallization layer formed on said surface of said cast resin winding body at least immediately adjacent to said wound core.

2. Single-phase transformer according to claim 1, wherein said flanges are spaced apart far enough to form a space therebetween after insertion of said wound core, and including cast resin filling said space and hermetically closing in said wound core.

3. Single-phase transformer according to claim 1, wherein said flanges are spaced apart far enough to form a space therebetween, said wound core having a rounded contour, and said outer edges of said flanges being rounded off parallel to said contour of said wound cores, and including tape wound around said wound core filling said space, said rounded outer edges of said flanges being covered by at least one layer of said tape protecting said wound core from corrosion.

4. Single-phase transformer according to claim 2 or 3, wherein said flanges have outer surfaces, and including connecting sockets for shock-proof water-tight high-voltage cable connectors cast onto said outer surfaces of said flanges and water-tight shrink-sleeve terminals for low-voltage connections.

5. Single-phase transformer according to claim 2 or 3, wherein said flanges have outer surfaces, and including pin insulator-type feed-throughs cast onto said outer surfaces of said flanges for high and low-voltage side current network connectors for line pole transformer connections.

6. Single-phase transformer according to claim 2 or 3, wherein said metallization layer formed on said outer surfacve of said cast resin winding body is spaced from said wound core far enough to form a gap therebetween, and including dried quartz sand filling said gap.

* * * * *